US009445708B2

(12) United States Patent
Ertl et al.

(10) Patent No.: US 9,445,708 B2
(45) Date of Patent: Sep. 20, 2016

(54) WATER-BEARING DOMESTIC APPLIANCE

(75) Inventors: Christian Ertl, Holzheim (DE); Bernd Heisele, Sontheim (DE); Michael Lugert, Jettingen-Scheppach (DE); Karl Wirth, Lauingen (DE)

(73) Assignee: BSH Hausgeräte GmbH, Munich (DE)

( * ) Notice: Subject to any disclaimer, the term of this patent is extended or adjusted under 35 U.S.C. 154(b) by 990 days.

(21) Appl. No.: 13/384,245

(22) PCT Filed: Jul. 22, 2010

(86) PCT No.: PCT/EP2010/060617

§ 371 (c)(1),
(2), (4) Date: Jan. 16, 2012

(87) PCT Pub. No.: WO2011/015460

PCT Pub. Date: Feb. 10, 2011

(65) Prior Publication Data

US 2012/0118339 A1 May 17, 2012

(30) Foreign Application Priority Data

Aug. 6, 2009 (DE) ..... 10 2009 028 274

(51) Int. Cl.
*A47L 15/00* (2006.01)
*A47L 15/42* (2006.01)

(52) U.S. Cl.
CPC ..... *A47L 15/4291* (2013.01); *A47L 15/4214* (2013.01); *A47L 15/4217* (2013.01); *A47L 15/4219* (2013.01); *A47L 15/0057* (2013.01); *A47L 15/4221* (2013.01)

(58) Field of Classification Search
CPC ..... A47L 15/4214; A47L 15/4219; A47L 15/4221; A47L 15/4291; A47L 15/4217
USPC ..... 134/56 D, 57 D, 58 D, 186
See application file for complete search history.

(56) References Cited

U.S. PATENT DOCUMENTS

2003/0159720 A1* 8/2003 Favret ..... 134/57 D
2005/0241675 A1* 11/2005 Jung ..... A47L 15/4244 134/18
2011/0056527 A1* 3/2011 Classen et al. ..... 134/56 D
2011/0114140 A1 5/2011 Heisele et al.

FOREIGN PATENT DOCUMENTS

DE 19505598 A1 8/1996
DE 102008040653 A1 * 1/2010 ..... A47L 15/0015
EP 0911439 A1 4/1999
WO WO 2009077286 A1 * 6/2009

OTHER PUBLICATIONS

International Search Report PCT/EP2010/060617.

* cited by examiner

*Primary Examiner* — Michael Barr
*Assistant Examiner* — Levon J Shahinian
(74) *Attorney, Agent, or Firm* — Michael Tschupp; Andre Pallapies

(57) ABSTRACT

A water-bearing domestic appliance, in particular a dishwasher, includes a liquid storage container, in particular a storage container in which washing liquid can be temporarily stored. At least one flow-control element is arranged in a liquid chamber of the storage container to divert and/or to split the washing liquor flowing into the storage container or being discharged from it.

36 Claims, 3 Drawing Sheets

WATER-BEARING DOMESTIC APPLIANCE

BACKGROUND OF THE INVENTION

The invention is a water-bearing domestic appliance, in particular a dishwasher, with a liquid storage container, in particular a storage container, which can be used for temporary storage of washing liquor.

The reduction of water consumption is of major significance for water-bearing domestic appliances. Using what is known as a storage container makes it possible to reduce water consumption. For example, the clear rinse water from one rinse cycle can be stored in the storage container until the next rinse cycle and used to pre-rinse the items to be washed in the dishwasher.

Following completion of a washing program, which may comprise a number of sub-program stages, such as pre-rinse, wash, interim rinse, clear rinse and dry, washing liquor not required following the clear rinse stage, for example, is temporarily stored in the storage container or generally in a storage container ready to be reused in a subsequent sub-program stage, such as pre-rinse.

Soiling in the form of fatty film and particles of dirt can become lodged in the storage container during washing programs. The likelihood of this increases as a consequence of the reduced process temperatures during washing programs.

BRIEF SUMMARY OF THE INVENTION

The object of the invention is to provide a water-bearing domestic appliance, in particular a dishwasher, in which any such contaminations can be removed in a straightforward manner.

In accordance with the characterizing section of claim 1, there is at least one flow control element in the liquid chamber of the storage container to divert and/or to divide the washing liquor flowing into or being discharged from the storage container. This makes it possible to ensure that the entire liquid chamber is subject to a flow during filling, emptying or flushing of the storage container. It is therefore possible to dispense with flow-free zones within the storage container, thus guaranteeing removal of the particles of dirt. Consequently, the conglomeration of particles of dirt does not result in any odor or hygiene problems or any detrimental effect upon the operation of the storage container.

It is therefore possible to create a laminar or turbulent flow profile in the storage container, depending upon the location of the flow control element, the geometry of the storage container and the speed of flow.

In order to ensure the storage container is flushed as consistently as possible, it is possible for the at least one flow control element to be used to define a flow duct in the liquid chamber. Depending upon the geometric conditions, the flow duct can extend in a circular or serpentine course through the liquid chamber of the storage container.

It is preferable for the flow duct to follow the line of an edge contour of the internal panel of the storage container. Areas which are located some distance from an inlet aperture in the storage container can therefore be subjected to targeted flow. All in all, therefore, it is possible to provide additional degrees of scope in terms of the geometry of the storage container.

The flow duct can therefore be arranged between the flow control element and the internal panel of the container.

This makes it possible to achieve a significant increase in cleaning efficiency during cleaning of storage container.

Furthermore, the speed of flow can be selected in such a way that the particles of dirt which have become attached to the inside of the storage container can be removed mechanically by the flow of liquid. Speeds of flow in the storage container in a magnitude of 20 to 30 l/min are preferable for this purpose. In order to improve the cleaning efficiency further, it is beneficial to heat the washing liquor fed into the storage container to a temperature of a magnitude of 60 to 75° C., whereby deposits of fat are broken down thermally and removed from the storage container.

In a special cleaning mode, the water-bearing domestic appliance can flush the storage container. To this end, washing liquor is pumped into the storage container by means of a liquid inlet and then fed back into a washing container in the dishwasher, for example, by means of an outlet aperture, whereby the outlet aperture is arranged to be physically separated from the liquid inlet.

In order to ensure that the flushing liquid remains in the storage container for a specified period, the liquid outlet can be screened against the flow duct by means of another flow control element, i.e. by creating a flow inlet, which connects the flow duct directly to the liquid outlet. This results on the one hand in a main flow flowing along the flow duct, while on the other hand a partial flow is fed through the flow outlet towards the outlet aperture in the storage container.

It is preferable for the at least one flow control element to take the form of a guide panel with a consistently low material thickness. The guide panel can be curved or angled as appropriate, in accordance with the geometrical conditions in the liquid chamber of the storage container. Furthermore, parts of the guide panel at least may be punctuated with cut-outs. This means that, with curves on the internal side of the guide wall in particular, it is possible to avoid voids in which particles of dirt would otherwise be able to settle.

The storage container can be manufactured in a straightforward manner from molded parts, which have themselves been produced in three-dimensional form in a plastic injection molding process. For example, the storage container may have two opposite side panels which cover substantially the same area. The two opposite side panels may have a liquid-tight connection in the form of a narrow circular border.

In order to save on materials, the storage container itself may have only limited dimensional stability. In this context, it is beneficial to use additional reinforcing elements to stabilize the storage container. It is a simple matter for the flow control elements to assume a dual function as these reinforcing elements, connecting the opposite side panels of the storage container and establishing a specified interval between them.

A further development provides for a multiplicity of flow control elements which together effect a substantially circular deflection. This ensures that any volume of liquid in the storage container is subjected to rotation, which guarantees that there are no areas in the storage container which are not flushed.

Another further development provides for two flow control elements, each of which effects a substantially semi-circular diversion. It is therefore possible, with a particularly straightforward design, to arrange two flow control elements to achieve a circular flow which covers all areas of the storage container in a storage container with rectangular dimensions, whereby the flow control elements are arranged opposite to one another.

One preferred embodiment provides for a flow of washing liquor divided by the at least one flow control element to run towards a liquid outlet. This presents a straightforward way of achieving particularly intensive flushing.

One preferred embodiment provides for the at least one flow control element to divide one flow of washing liquor into at least two flows of washing liquor of substantially the same magnitude. This makes it possible to flush at least two different areas at the same time. However, it is also possible to provide for the flow of washing liquor to be divided into three or four flows, for example.

BRIEF DESCRIPTION OF THE DRAWINGS

There follows a description of an exemplary embodiment of the invention using the figures attached. Wherein.

DETAILED DESCRIPTION OF EXEMPLARY EMBODIMENTS OF THE PRESENT INVENTION

Figure 1:
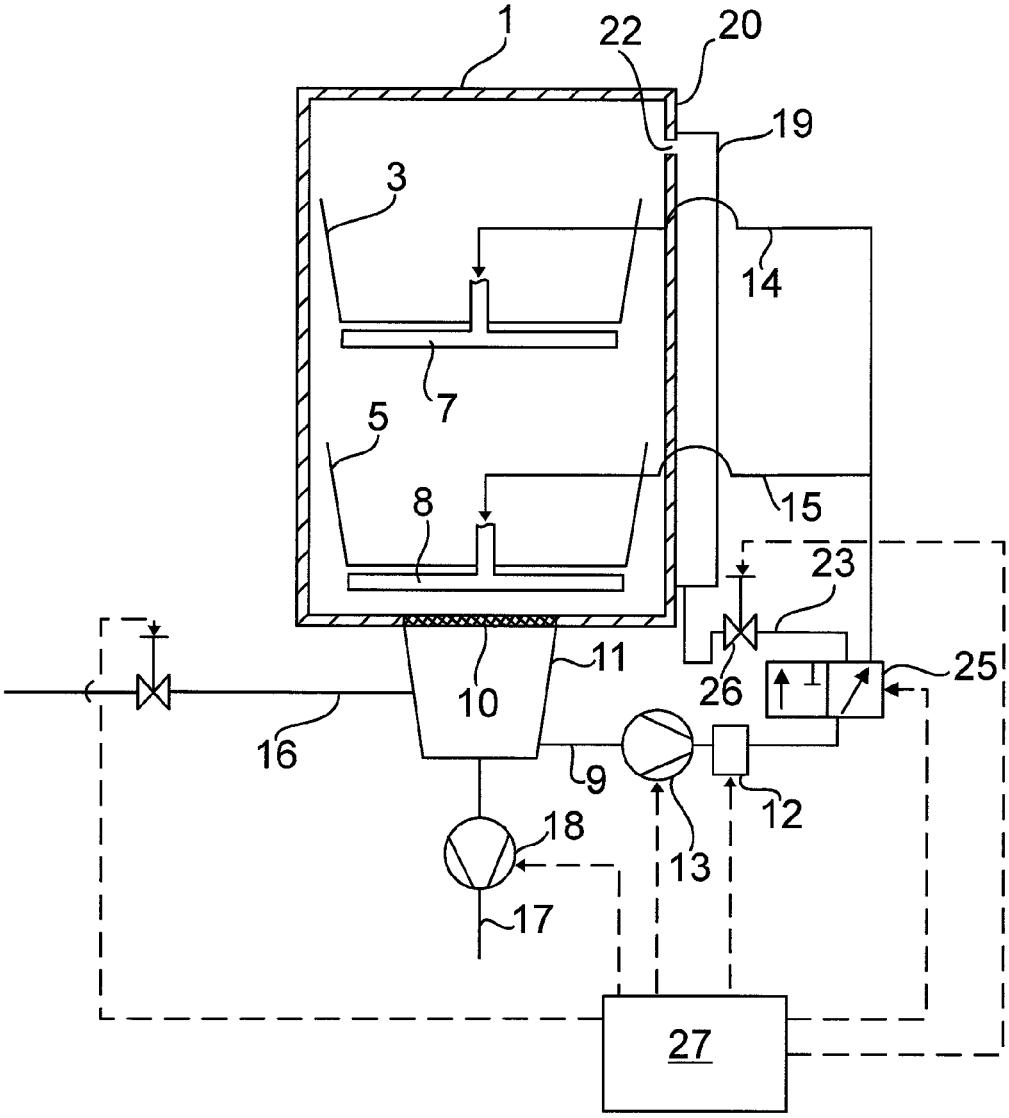
FIG. 1 shows a schematic block diagram of a dishwasher.

FIG. 1 shows a schematic representation of a dishwasher with a washing container 1 enclosing a washing chamber. Items to be washed, which are not illustrated, can be arranged in cutlery baskets 3, 5 in the washing chamber in the washing container 1. The washing container 1 illustrated shows examples of two spray arms 7, 8 arranged at different spray levels; these are used to spray washing liquor onto the items to be washed. A sump 11 with a filter arrangement which is outlined only 10 is provided in the base of the washing container. A circulation pipe 9 with a circulation pump 13 arranged in it leads away from the sump 11. Feed lines 14, 15 create a fluidic connection between the circulation pipe 9 and the spray arms 7, 8. A heating element designated as a water heater, such as a flow heater, is connected downstream of the circulation pump 13.

The sump 11 is also connected by means of connection fittings to a fresh water supply pipe 16 and to a discharge pipe 17, in which a washing liquor pump 18 is arranged to pump the washing liquor out of the washing container.

On its right-hand side in FIG. 1, shown as storage container 19, the washing container has a "storage container", which has a thermal connection, in the manner of a heat exchanger, with a side panel 20 of the washing container 1. The storage container 19 can be used for temporary storage of washing liquid which is no longer required after one sub-program stage of a washing cycle has been completed. The storage container 19 has a fluidic connection with the washing chamber by means of an aeration and ventilation aperture in its upper section.

In order to perform a washing cycle, the sump 11 with filter arrangement 10 assigned, the circulating pipe, the feed lines 14, 15 and the two spray arms 7, 8 are among the features integrated into the liquid circuit in the dishwasher.

The storage container 19, on the other hand, is not integrated into the liquid circuit.

In fact, a water diverter in the form of a three-way control valve 25 is provided downstream of the heating element 12 in the circulating pipe 9, from which a connecting pipe 23 branches off, which is connected to an inlet aperture 28 on the storage container 19.

Figure 2:
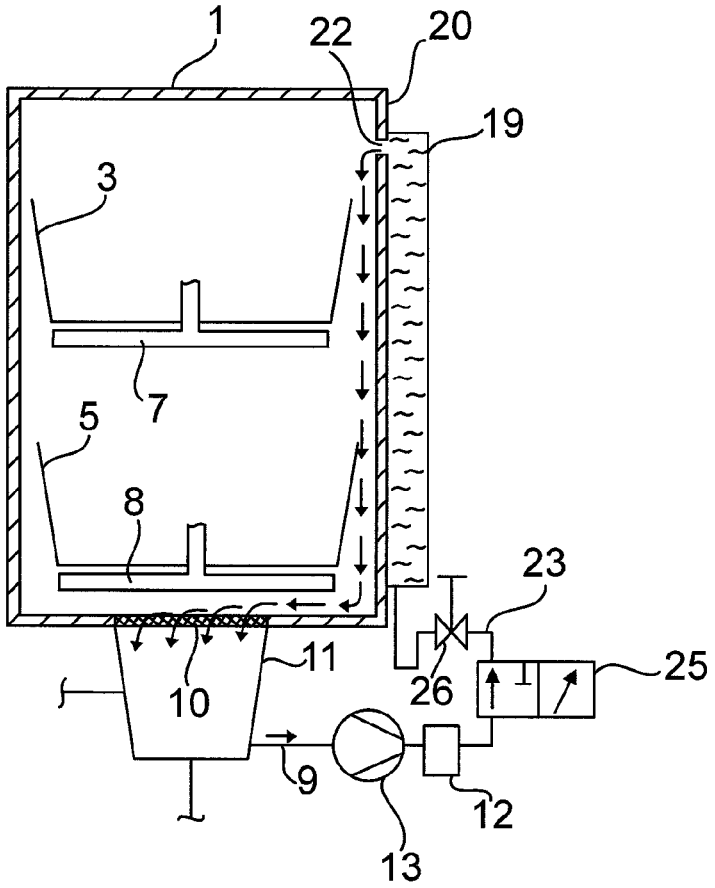
FIG. 2 shows a view in accordance with FIG. 1 to explain cleaning of a storage container.

In an operating position illustrated in FIG. 2, the three-way control valve 25 connects the circulating pipe 9 with the connecting pipe 23 leading to the storage container 19 and interrupts the fluidic path to the feed lines 14, 15. As a consequence, it is possible, in a special cleaning mode, for washing liquor to be pumped into the storage container 19 by means of the inlet aperture 28 shown in FIG. 3 and to fill it until the washing liquor enters the washing container 1 by means of the aeration and ventilation aperture 22 and is fed back along the washing container panel 20 and past the cutlery baskets 3, 5 into the sump 11 with assigned filter arrangement 10.

A storage container valve 26 is provided in order to ensure that filling or emptying of the storage container 19 can be controlled by means of the regulation device 27. The valve 26 is arranged in the connecting pipe 23 leading to the storage container 19 and is in its Open position during the above cleaning mode.

The dishwasher's washing cycle starts with the pre-rinse stage, in which a volume of clear rinse water from the previous washing cycle which has been stored temporarily in the storage container 19 is allowed to pass into the sump section of the washing container 1. To this end, the stop valve 26 is opened and the three-way switching valve 25 is switched into the position illustrated in FIG. 2.

The volume of clear rinse water held in temporary storage in the storage container 19 can therefore flow into the sump section of the washing container 1 by means of the force of gravity. The three-way switching valve 25 is then switched into its operating position as illustrated in FIG. 1 and the circulation pump 13 is started, which enables the clear rinse water to circulate during the washing cycle. Once the pre-rinse stage has been completed, the used washing liquor is pumped out by means of the washing liquor pump 18 and fresh water is then fed into the sump section for the next stage of the cleaning process.

In order to conduct cleaning of the storage container, the circulation pump 13 pumps washing liquor into the storage container 19 at a high rate of flow. This flushes a liquid chamber 31 in the storage container 19 illustrated in FIG. 3 and is discharged through a liquid outlet 33 in the storage container 19.

The washing liquor used during cleaning of the storage container is heated to temperatures of a magnitude of 70° C., whereby particles of dirt can be loosened in the liquid chamber 31 of the storage container 19 and removed.

Figure 3:
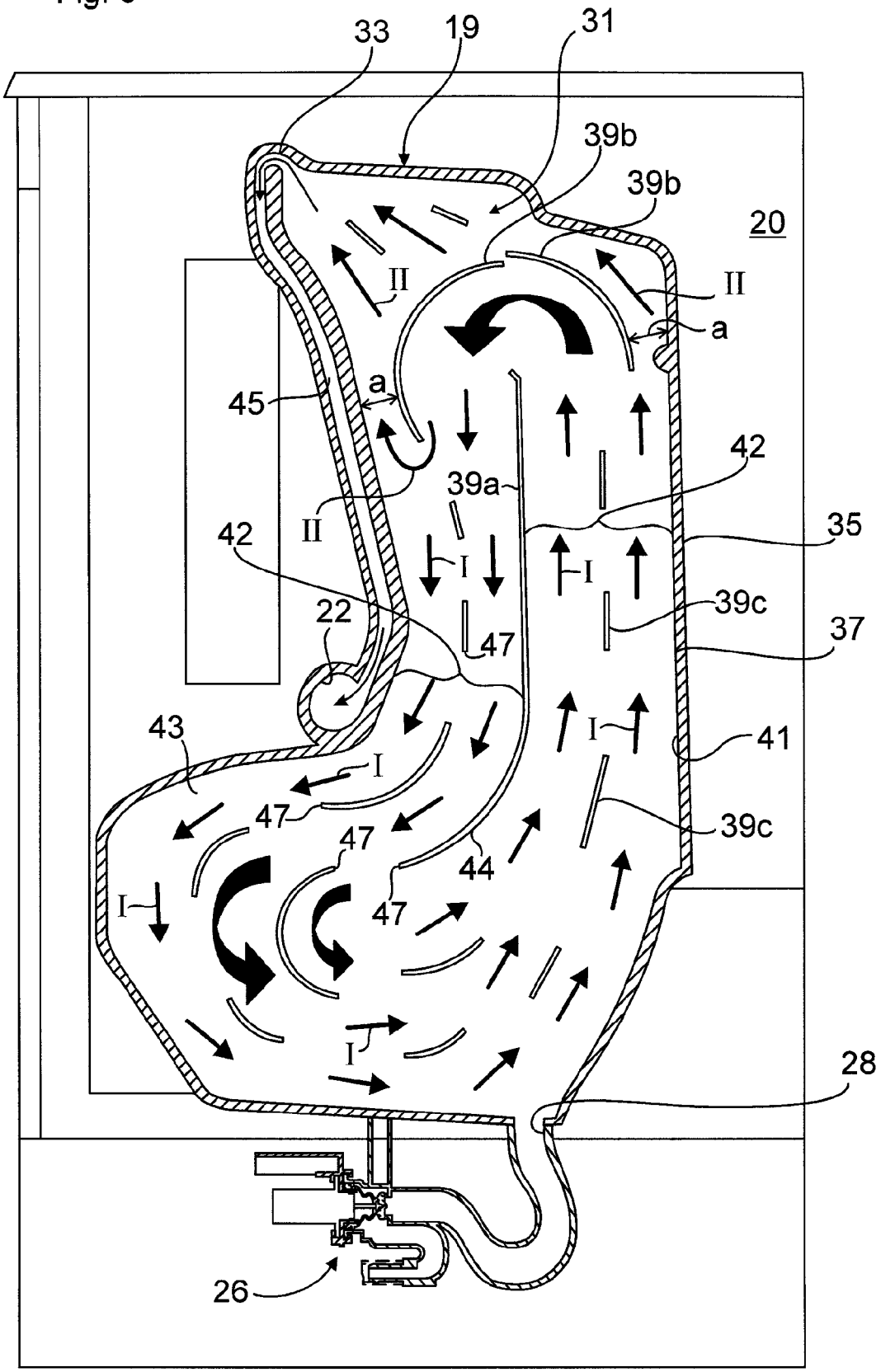
FIG. 3 shows a lateral cross-sectional representation of a liquid chamber in a storage container arranged in the dishwasher.

FIG. 3 shows a side view of the dishwasher with a storage container 19 shown as a full section on a lateral plane. As already apparent from FIGS. 1 and 2, the storage container 19 is directly adjacent to the side panel of the washing container 20. FIG. 3 illustrates cleaning of the storage container. According to the illustration, the storage container valve 26 is opened, whereby the circulation pump 13 is able to pump washing liquor into the liquid chamber 31 of the storage container 19 by means of the inlet aperture 27.

The storage container 19 made of plastic material has two side panels covering substantially the same area 35, of which FIG. 3 shows only that side panel 35 attached to the side panel of the washing container 20. In accordance with FIG. 3, side panel 35 has a continuous edge flange 37, which may for example form an adhesive connection with the side panel opposite.

Flow control elements 39 are arranged inside the liquid chamber 31. The flow control elements 39, 47 are arranged in such a way as to create a substantially annular main flow I, which runs along an internal panel of the internal contour 41 of the storage container 19.

Thus, in accordance with FIG. 3, there is provision for a substantially vertically aligned flow control element 39*a*, arranged centrally between two side container panels of the storage container 19. A flow duct 42 is formed between the flow control element 39*a* and the internal panel 41, along which the main flow I is first routed upwards along the right side shown in FIG. 3 and then diverted 180° into the opposite direction by means of a diversion element 39*b*.

The main flow I is then fed further into a lower section of the liquid chamber hollowed out to the left 43, in accordance with FIG. 3, and then back into the inflow area of the inlet aperture 27. In order to control the flow in this way, the flow control element 39*a* has a curved section 44, which diverts the main flow I into area 43.

As also shown in FIG. 3, the diversion element 39*b* is also used for extensive screening of the liquid outlet 33 against the main flow I. Flow spaces a also separate the diversion element 39 *b* from the internal panel 41 of the liquid container 19 whereby a part flow II is branched off from the main flow I and flows towards the liquid outlet 33.

The liquid outlet 33 of the storage container 19 feeds into an outlet duct 45, which feeds the washing liquor to the aeration and ventilation aperture 22. In FIG. 3, this is arranged not in the top corner section, but about halfway up the washing container 1.

As also shown in FIG. 3, the flow control elements 39, 47 are designed as guide panels, which have a dual function, acting as spacers connecting the opposing side panels 35 of the storage container 19.

In order to prevent deposits accumulating on the inside of the curve around the curved section 44 in particular, the flow control element 39*a* is punctuated with cut-outs. This makes it possible to flush an area on the inside of the curved section 44 which would otherwise form a void.

The approximately annular flow guide along the internal panel 41 of the storage container 19 is stabilized further by additional flow control elements 39*c*. The flow control elements 39*c* are arranged approximately in the centre of flow duct 42 for the main flow I and are also separated from one another by means of cut-outs.

LIST OF REFERENCE CHARACTERS

1 Washing container
3, 5 Cutlery baskets
7, 8 Spray arms
9 Circulating pipe
10 Filter arrangement
11 Sump
12 Heating element
13 Circulating pump
14, 15 Feed lines
16 Fresh water supply pipe
17 Drainage pipe
18 Washing liquor pump
19 Storage container
20 Side panel of washing container
22 Aeration and ventilation aperture
23 Connection pipe
25 Three-way switching valve
27 Control device
28 Liquid inlet
31 Liquid chamber
33 Liquid outlet
35 Side panel of storage container 19
37 Edge flange
39*a*, 39*b*, 39*c* Flow control elements
41 Internal panel
42 Flow duct
43 Area of liquid chamber
44 Curved section
45 Outlet duct
47 Flow control elements
a Outlet
I Main flow
II Partial flow

The invention claimed is:

1. A water-bearing domestic appliance, comprising:

a washing container;

a liquid storage container configured to, in use, temporarily store extra washing liquor used in a previous washing cycle, said liquid storage container being configured to direct the extra washing liquor that is temporarily stored in the liquid storage container into the washing container for re-use in a subsequent sub-program stage, and said liquid storage container having a liquid chamber, a liquid inlet connecting the washing container to the liquid chamber to direct the extra washing liquor from the washing container into the liquid chamber, and a liquid outlet connecting the liquid chamber to the washing container to direct the extra washing liquor from the liquid chamber into the washing container;

a liquid storage container valve positioned upstream of the liquid inlet to control a flow of extra washing liquor from the washing container into the liquid chamber; and at least one flow control element fixed within the liquid chamber of the storage container to divert and/or to split the washing liquor flowing within the storage container into a circulatory flow.

2. The water-bearing domestic appliance of claim 1, constructed in the form of a dishwasher.

3. The water-bearing domestic appliance of claim 1, wherein the storage container has at least one internal panel, wherein said at least one flow control element has a first side and a second side, and wherein the at least one flow control element delimits a flow duct within the storage container and on each side of the at least one flow control element such that the washing liquor flowing within the storage container passes through the flow duct, along each side of the at least one flow control element, and between the at least one flow control element and the at least one internal panel when flowing from the liquid inlet to the liquid outlet.

4. The water-bearing domestic appliance of claim 3, wherein the flow duct extends in a circular or serpentine form through the liquid chamber of the storage container.

5. The water-bearing domestic appliance of claim 3, wherein the flow duct follows a contour of the internal panel of the storage container.

6. The water-bearing domestic appliance of claim 3, wherein the flow control element delimits the flow duct to extend through the liquid chamber of the storage container, and further comprising another flow control element to screen the liquid outlet from the flow duct.

7. The water-bearing domestic appliance of claim 6, wherein the other flow control element forms at least one outlet connecting the flow duct with the liquid outlet.

8. The water-bearing domestic appliance of claim 1, wherein the flow control element takes the form of a guide panel with substantially consistent material thickness.

9. The water-bearing domestic appliance of claim 1, wherein the flow control element is arranged with at least one curve section to specify a direction of flow.

10. The water-bearing domestic appliance of claim 1, wherein the flow control element is punctuated with cut-outs in part at least.

11. The water-bearing domestic appliance of claim 1, wherein the storage container is made of plastic material.

12. The water-bearing domestic appliance of claim 1, wherein the storage container has two side panels covering substantially a same area, which have a narrow peripheral border providing them with a liquid-tight connection to one another.

13. The water-bearing domestic appliance of claim 1, wherein the flow control element takes the form of a spacer connecting opposite container panels of the storage container.

14. The water-bearing domestic appliance of claim 1, further comprising a multiplicity of said flow control elements to effect together a substantially circular deflection.

15. The water-bearing domestic appliance of claim 1, further comprising a second of said flow control elements, each of which effecting a substantially semicircular diversion.

16. The water-bearing domestic appliance of claim 1, further comprising a control element configured to (1) in a filling mode, enable filling of the storage container with said extra washing liquor, (2) in an emptying mode, enable emptying of the extra washing liquor stored in the storage container into the washing container, after which the washing liquor is circulated by at least one sprayer within the washing container, and (3) commence a cleaning mode in which fresh water is introduced into the storage container and in contact with the flow control element to flush dirt from interior surfaces of the storage container.

17. The water-bearing domestic appliance of claim 16, wherein during the filling, emptying and the cleaning modes, flow of washing liquor to each said sprayer is interrupted.

18. The water-bearing domestic appliance of claim 1, wherein the at least one flow control element is fixed between the liquid inlet and the liquid outlet.

19. A water-bearing domestic appliance, comprising:

a washing container having at least one sprayer to spray washing liquor onto items to be washed;

a liquid storage container having a liquid chamber to store a washing liquor, a liquid inlet connecting the washing container to the liquid chamber to direct the washing liquor from the washing container into the liquid chamber, and a liquid outlet connecting the liquid chamber to the washing container to direct the washing liquor from the liquid chamber into the washing container;

a liquid storage container valve positioned upstream of the liquid inlet to control a flow of washing liquor from the washing container into the liquid chamber;

at least one flow control element fixed within the liquid chamber of the storage container to divert and/or to split the washing liquor flowing within the storage container into a circulatory flow; and a control element configured to: (1) in a filling mode, enable temporary filling of the storage container with extra washing liquor that is no longer required after a program stage of a washing cycle has been completed, (2) in an emptying mode, enable emptying of the extra washing liquor stored in the storage container into the washing container, after which the washing liquor is circulated by at least one sprayer, and (3) commence a cleaning mode in which fresh water is introduced into the storage container and in contact with the flow control element to flush dirt from interior surfaces of the storage container.

20. The water-bearing domestic appliance of claim 19, wherein during the filling, emptying and the cleaning modes, flow of washing liquor to each said sprayer is interrupted.

21. The water-bearing domestic appliance of claim 19, wherein the storage container has at least one internal panel, wherein said at least one flow control element has a first side and a second side, and wherein the at least one flow control element delimits a flow duct within the storage container and on each side of the at least one flow control element such that the washing liquor flowing within the storage container passes through the flow duct, along each side of the at least one flow control element, and between the at least one flow control element and the at least one internal panel when flowing from the liquid inlet to the liquid outlet.

22. The water-bearing domestic appliance of claim 21, wherein the flow duct extends in a circular or serpentine form through the liquid chamber of the storage container.

23. The water-bearing domestic appliance of claim 21, wherein the flow duct follows a contour of the internal panel of the storage container.

24. The water-bearing domestic appliance of claim 21, wherein the storage container further comprises another flow control element to screen the liquid outlet from the flow duct.

25. The water-bearing domestic appliance of claim 24, wherein the other flow control element forms at least one outlet connecting the flow duct with the liquid outlet.

26. The water-bearing domestic appliance of claim 19, wherein the flow control element takes the form of a guide panel with substantially consistent material thickness.

27. The water-bearing domestic appliance of claim 19, wherein the flow control element is arranged with at least one curve section to specify a direction of flow.

28. The water-bearing domestic appliance of claim 19, wherein the flow control element is punctuated with cut-outs in part.

29. The water-bearing domestic appliance of claim 19, wherein the storage container has two side panels covering substantially a same area, which have a narrow peripheral border providing them with a liquid-tight connection to one another.

30. The water-bearing domestic appliance of claim 19, wherein the flow control element takes the form of a spacer connecting opposite container panels of the storage container.

31. The water-bearing domestic appliance of claim 19, further comprising a multiplicity of said flow control elements to effect together a substantially circular deflection.

32. The water-bearing domestic appliance of claim 19, wherein the at least one flow control element is fixed between the liquid inlet and the liquid outlet.

33. A water-bearing domestic appliance, comprising:

a washing container having at least one sprayer to spray washing liquor onto items to be washed;

a liquid storage container having a liquid chamber to store a washing liquor from a previous cycle for re-use in a subsequent cycle, a liquid inlet connecting the washing container to the liquid chamber to direct the washing liquor from the washing container into the liquid chamber, and a liquid outlet connecting the liquid chamber to the washing container to direct the washing liquor from the liquid chamber into the washing container;

a liquid storage container valve positioned upstream of the liquid inlet to control a flow of washing liquor from the washing container into the liquid chamber;

at least one flow control element fixed within the liquid chamber of the storage container to divert and/or to split the washing liquor flowing within the storage container into a circulatory flow; and a control element configured to alternatively direct the washing liquor to (1) the liquid storage container and (2) the at least one sprayer and not the liquid storage container.

34. The water-bearing domestic appliance of claim 33, wherein the control element is operable (1) in a filling mode to enable temporary filling of the storage container with washing liquor from a previous washing cycle, (2) in an emptying mode, to enable emptying of the washing liquor stored in the storage container for re-use in the washing container, after which the washing liquor is circulated by the at least one sprayer, and (3) to commence a cleaning mode in which fresh water is introduced into the storage container and in contact with the flow control element to flush dirt from interior surfaces of the storage container.

35. The water-bearing domestic appliance of claim 34, wherein during the filling, emptying and the cleaning modes, flow of washing liquor to each said sprayer is interrupted.

36. The water-bearing domestic appliance of claim 33, wherein the at least one flow control element is fixed between the liquid inlet and the liquid outlet.

* * * * *